US007662075B2

(12) United States Patent
Isom

(10) Patent No.: US 7,662,075 B2
(45) Date of Patent: Feb. 16, 2010

(54) SQUAT MACHINE FOR EXERCISING

(75) Inventor: Larry H. Isom, Panora, IA (US)

(73) Assignee: Conner Athletic Products, Inc., Jefferson, IA (US)

( * ) Notice: Subject to any disclaimer, the term of this patent is extended or adjusted under 35 U.S.C. 154(b) by 0 days.

(21) Appl. No.: 12/175,026

(22) Filed: Jul. 17, 2008

(65) Prior Publication Data

US 2009/0029834 A1 Jan. 29, 2009

Related U.S. Application Data

(60) Provisional application No. 60/962,282, filed on Jul. 27, 2007.

(51) Int. Cl.
*A63B 21/08* (2006.01)
*A63B 23/04* (2006.01)

(52) U.S. Cl. ..... 482/97; 482/100; 482/129; 482/137; 482/145

(58) Field of Classification Search ..... 482/97, 482/100, 129, 137, 145
See application file for complete search history.

(56) References Cited

U.S. PATENT DOCUMENTS 4,149,714 A 4/1979 Lambert, Jr.
4,333,644 A 6/1982 Lambert, Jr. et al.
4,828,254 A 5/1989 Maag
4,872,670 A * 10/1989 Nichols ..... 482/135
5,106,080 A 4/1992 Jones
5,411,458 A * 5/1995 Giust ..... 482/101
5,484,365 A 1/1996 Jones et al.
5,549,533 A 8/1996 Olson et al.
5,554,086 A * 9/1996 Habing et al. ..... 482/137
5,603,678 A * 2/1997 Wilson ..... 482/97
5,626,548 A * 5/1997 Coyle ..... 482/137
5,628,715 A 5/1997 Simonson
5,722,917 A * 3/1998 Olschansky et al. ..... 482/72
6,093,135 A * 7/2000 Huang ..... 482/72

(Continued)

OTHER PUBLICATIONS

"FreeMotion Squat", Freemotion model GZFM6010, product page from www.freemotionfitness.com/webapp/wcs/stores/servlet/ProductDisplay. (1 page).

(Continued)

*Primary Examiner*—Loan H Thanh
*Assistant Examiner*—Victor K Hwang
(74) *Attorney, Agent, or Firm*—McKee, Voorhees & Sease, P.L.C.

(57) ABSTRACT

The squat machine of the present invention includes a base having opposite sides, a stationary foot plate fixed on the base, a pair of frames each pivotally mounted to respective sides of the base, and a back rest pivotally mounted to the frames so that the frames and back rests are moveable between an initial squat position and an extended position. The back rest is oriented at approximately a 45°-60° angle in the squat position and moves toward a substantially horizontal orientation in the extended position. In use, with proportional foot platement on the foot plate, the user's knees remain behind their toes throughout full range of motion through the hips during movement of the back rest so as to minimize risk of knee shear. The orientation of the back rest minimizes risk of spinal compression during use of the machine.

18 Claims, 4 Drawing Sheets

U.S. PATENT DOCUMENTS

| | | | | |
|---|---|---|---|---|
| D431,615 | S | 10/2000 | Webber et al. | |
| D438,918 | S | 3/2001 | Batea et al. | |
| 6,220,993 | B1 | 4/2001 | Sencil | |
| 6,251,052 | B1 * | 6/2001 | Simonson | 482/100 |
| 6,537,185 | B1 * | 3/2003 | Hur | 482/142 |
| 6,605,024 | B2 * | 8/2003 | Stearns | 482/142 |
| D481,428 | S | 10/2003 | Giannelli et al. | |
| 6,752,745 | B1 * | 6/2004 | Davis | 482/72 |
| 6,802,800 | B1 | 10/2004 | Hobson | |
| 6,991,588 | B1 | 1/2006 | Adams | |
| 7,004,890 | B2 | 2/2006 | Webb et al. | |
| 7,004,891 | B2 | 2/2006 | Morris et al. | |
| 7,044,898 | B2 * | 5/2006 | Kuo et al. | 482/121 |
| 7,070,545 | B2 | 7/2006 | Lull et al. | |
| 7,083,552 | B2 * | 8/2006 | Carter | 482/93 |
| 7,115,080 | B2 | 10/2006 | Cockrill, Jr. et al. | |
| 7,115,081 | B2 * | 10/2006 | Stearns | 482/140 |
| 7,276,033 | B2 * | 10/2007 | Phillips | 601/23 |
| 7,331,911 | B2 * | 2/2008 | Webber et al. | 482/137 |
| 2002/0173412 | A1 * | 11/2002 | Stearns | 482/123 |
| 2003/0158018 | A1 * | 8/2003 | Giannelli et al. | 482/95 |

OTHER PUBLICATIONS

"FM Epic Leg Press", Freemotion model GZF18043, product page from www.freemotionfitness.com/webapp/wcs/stores/servlet/ProductDisplay. (1 page).

"FM Epic PlateLoaded Leg Press", Freemotion model GZFW2185, product page from www.freemotionfitness.com/webapp/wcs/stores/servlet/ProductDisplay. (1 page).

"FM Epic PlateLoaded Squat", Freemotion model GZFW2174, product page from www.freemotionfitness.com/webapp/wcs/stores/servlet/ProductDisplay. (1 page).

Hammer Strength "V-Squat", LifeFitness product page from us.commercial.lifefitness.com/content.cfm/v-squat. (2 pages).

Hoist Leg Composite Motion RPL-5403, product page from www.hoistrocit.com/products/plate_loaded. (1 page).

Bun and Thigh Rocker Review, from www.fitnessinfomercialreview.com/reviews/bunandthighrocker. (2 pages).

* cited by examiner

SQUAT MACHINE FOR EXERCISING

CROSS-REFERENCE TO RELATED APPLICATIONS

This application claims priority under 35 U.S.C. §119 of a provisional application Ser. No. 60/962,282 filed Jul. 27, 2007, which application is hereby incorporated by reference in its entirety.

BACKGROUND OF THE INVENTION

One exercise commonly used by people doing weight training or conditioning, or people doing knee or leg rehabilitation, is squats, wherein the person moves between a bent-knee squat or crouch position and an extended position with the legs substantially straight, using a desired amount of weight or resistive force. Squats may be done using free weights or on a squat machine. Free weights rely completely upon the user's own body to control movement of the weight, and thus presents safety concerns which make it advisable to have a spotter or training partner to increase safety. Weight training machines eliminate some of the safety concerns of free weights, and thus allow some users to exercise alone, with a decreased need for a training partner for assistance.

Squat machines are one type of exercise equipment which allow a user to simulate free-weight squats with minimized risk. Squat machines typically have a base with a foot plate and a back rest, one of which is pivotally connected to the base. After the user selects the desired weight or resistive force, the user positions themselves with their back against the back rest and their feet against the foot plate, and then use their legs to move between a squat position and an extended position, with the weight providing resistance during such movement. However, conventional squat machines either limit range of hip motion, or subject the user to potential knee shear resulting from movement of the knee forwardly beyond the toes. Also, in some squat machines, as well as with free weights, the load or force of the weights on the spine may result in spinal compression. Both knee shear and spinal compression may cause serious medical conditions. Limited hip motion reduces the benefits or results of the exercise. Some squat machines also orient the user in a standing position, such that their own body weight is a part of the exercise. However, such body weight may be undesirable in some situations, such as rehabilitative therapy or exercising.

Therefore, a primary objective of the present invention is the provision of an improved squat machine for weight training, exercising conditioning and rehabilitation therapy.

Another objective of the present invention is the provision of a squat machine which allows full range of motion while minimizing or eliminating the risk of knee shear.

Another object of the present invention is the provision of a squat machine which minimizes or eliminates the risk of spinal compression.

Still another object of the present invention is the provision of a squat machine which allows a full range of hip motion.

Another object of the present invention is the provision of a squat machine wherein the user starts in an intermediate position.

A further objective of the present invention is the provision of an exercise squat machine which maintains the knee behind the toes during the squatting motion through a full range of hip motion.

Still another objective of the present invention is the provision of a squat machine which utilizes various resistance members, including free weights, weight stacks, and resistance bands.

Yet another objective of the present invention is the provision of a squat machine having a fixed foot plate and a pivotal back rest.

A further objective of the present invention is the provision of a squat machine wherein the weights move through an arc so as to increase resistance as the motion distance increases.

Yet another object is the provision of a squat machine which allows a user to do one legged squats.

Another objective of the present invention is the provision of a squat machine wherein the user moves between a squat position and a substantially horizontal extended position.

Still another object of the present invention is the provision of a squat machine which is easy to set up and adjust.

A further object of the present invention is the provision of a squat machine having storage for additional weight plates.

Another object of the present invention is the provision of a squat machine wherein the weights are supported by a swinging or pivotal frame.

A further objective of the present invention is the provision of a squat machine which is durable and safe in use.

These and other objectives will become apparent from the following description of the invention.

BRIEF SUMMARY OF THE INVENTION

The squat machine of the present invention includes a base which rests upon the floor. A foot plate is rigidly mounted on the base, and a backrest is pivotally mounted on the base. The back rest is adapted for movement between a squat position and an extended position by a person oriented with their back engaging the back rest and at least one foot engaging the foot plate. A frame assembly is pivotally mounted on the base for supporting a resistive force, such as weight plates. A rigid linkage operatively connects the assembly to the back rest. A foot rest may also be provided so that a person has the option of doing one or two legged squats on a machine.

In use, a person begins in an intermediate position, between the full squat and full extension positions, with their feet on the foot plate, their knees bent, and their back against the back rest, which is oriented approximately 45°-60° relative to a horizontal plane. The person then pushes against the foot plate so as to pivot the back rest rearwardly to a substantially horizontal orientation when their legs are straight. Resistance to the pivotal movement is provided by weights or elastic bands on the frame assembly.

The squat machine minimizes or eliminates risk of knee shear and spinal compression, while allowing a user to exercise through a full range of motion of the hips.

DETAILED DESCRIPTION OF THE PREFERRED EMBODIMENT

Figure 1:
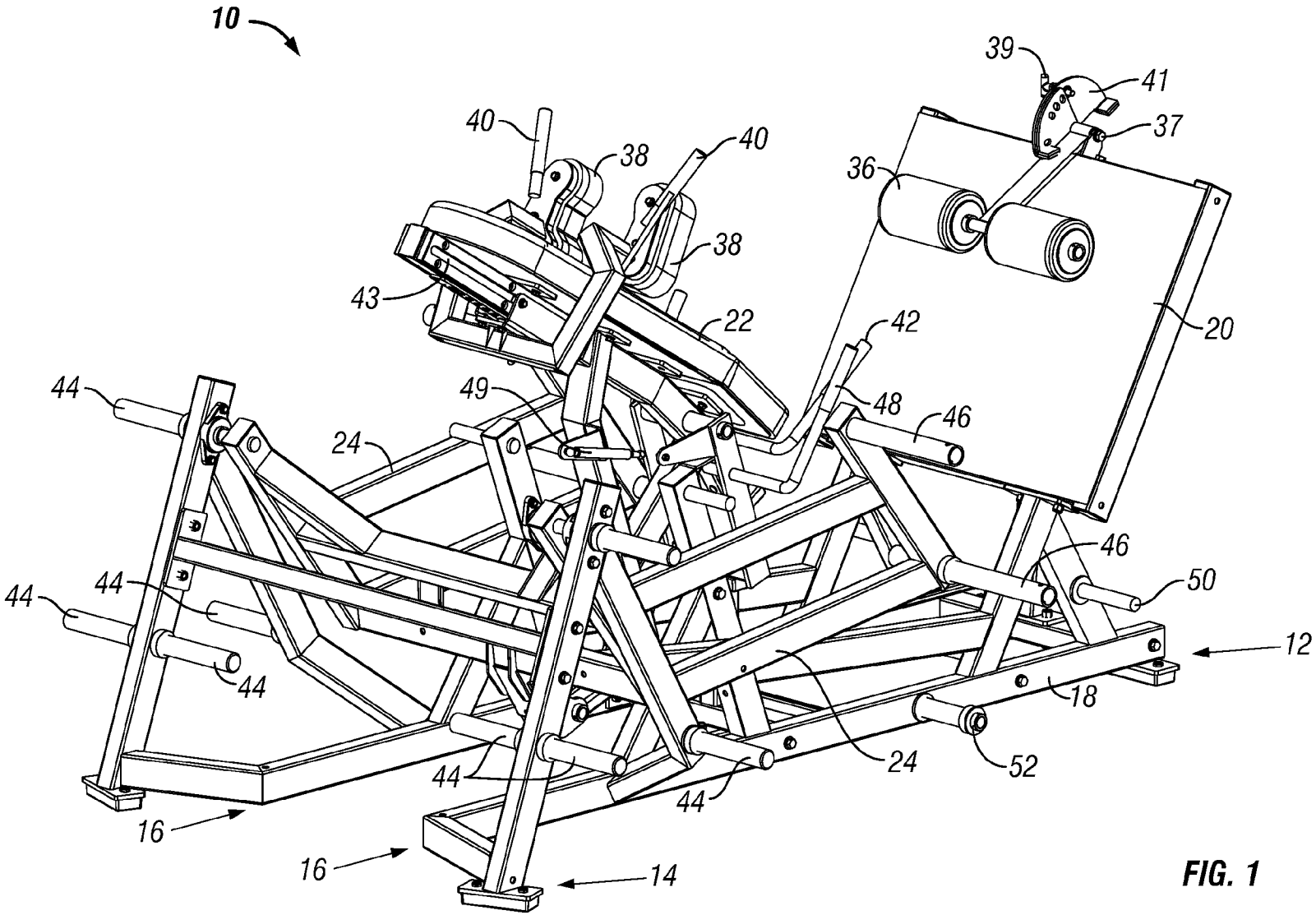
FIG. 1 is a perspective view of the squat machine of the present invention.

The squat machine 10 of the present invention has a front end 12, and rear end 14, and opposite sides 16. The machine 10 is generally symmetrical on opposite sides of a longitudinal axis. The primary components of the squat machine 10 are a base 18 adapted to rest upon a floor or other support surface, a foot plate 20 fixed on the base 18, a back rest 22 pivotally mounted on the base 18, frame assembly 24 for supporting a resistive force, and a rigid linkage 26 interconnecting the back rest 22 and the assembly 24.

Figure 4:
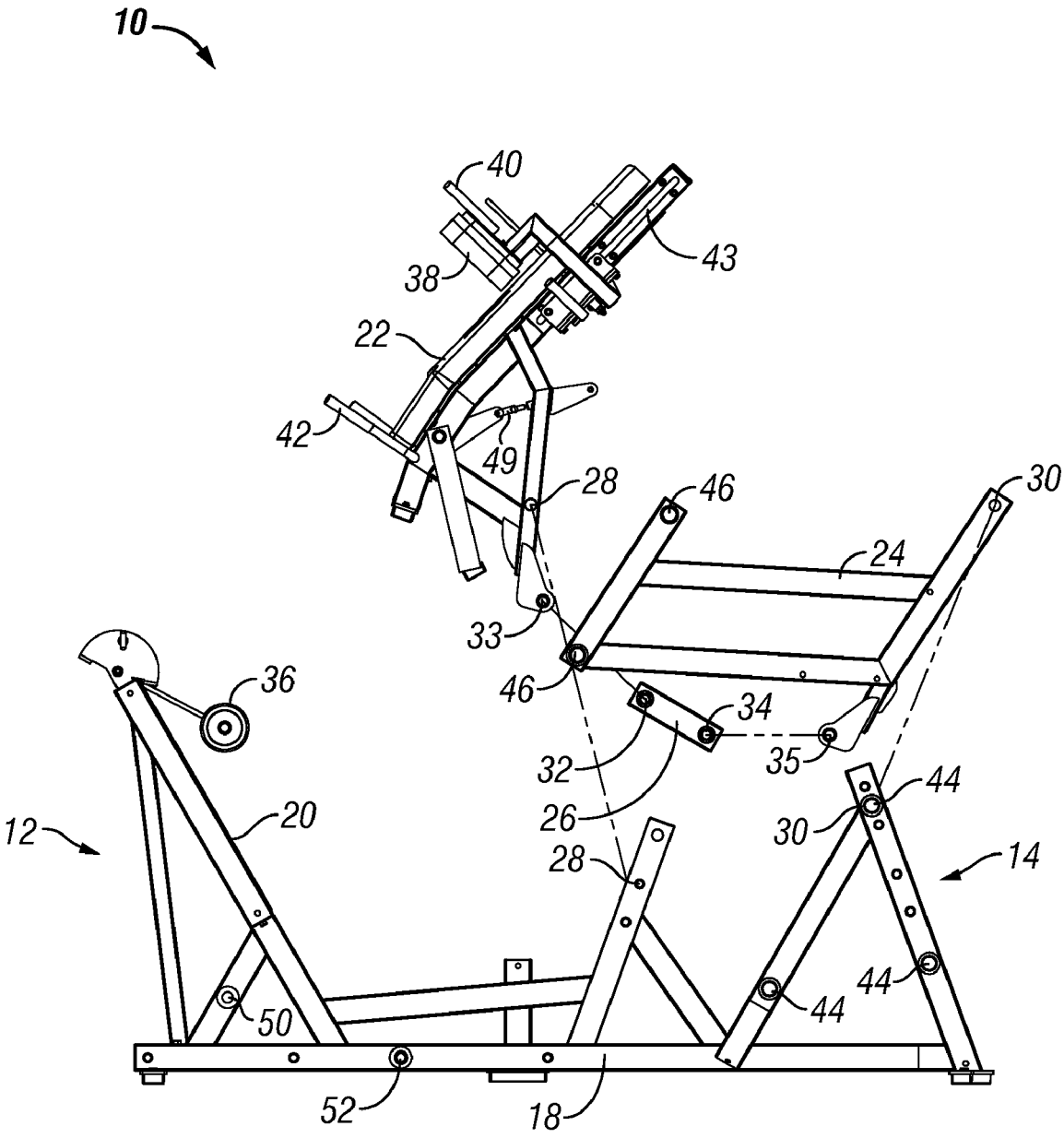
FIG. 4 is an exploded side elevation view of the squat machine showing the primary components thereof.

The drawings show a preferred embodiment of the squat machine 10, wherein the back rest 22 is pivotally connected to the base 18 for movement about a pivot axis 28, and the assembly 24 is pivotally connected to the base 18 for movement about a pivot axis 30. The linkage 26 includes a first end 32 pivotally connected to the back rest 22 at pivot axis 33, and a second end 34 pivotally connected to the assembly 24 at pivot axis 35. The assembly 24 includes opposite sides each in the form of a parallelogram frame, as best seen in FIG. 4.

As seen in the drawings, the foot plate 20 and back rest 22 extend angularly upwardly from the base 18 in opposite directions. An adjustable leg support 36 may be provided adjacent the foot plate 20, which allows a user to do one legged squats on the squat machine 10. The leg support can be pivoted to a selected position about an axis 37 and retained in position by a pin 39 extending through holes in a mounting plate 41 connected to the foot plate 20. The back rest 22 includes adjustable shoulder pads 38 so as to accommodate persons having different heights. The pads 38 are movable along a track or rail 43 on the back side of the back rest and are fixed in a selected position by any convenient means. Upper and lower hand grips 40, 42 are provided on the back rest 22. Stub shafts 44 are rigidly mounted on the base 18 to store weight plates (not shown). Stub shafts 46 are rigidly mounted on the assembly 24 to hold the weight plates during use of the machine 10.

The orientations of the back rest and foot plate allow a shorter person to position themselves closer to the foot plate 20, while a taller person can position themselves further from the foot plate, thereby accommodating their various leg lengths. The machine 10 includes a lock lever 48 adjacent the back rest 22 to temporarily lock the back rest in an angled intermediate position between the squat and extended positions via an extensible and retractable cylinder 49, for facilitating entry and exit of a person using the squat machine 10.

Figure 2:
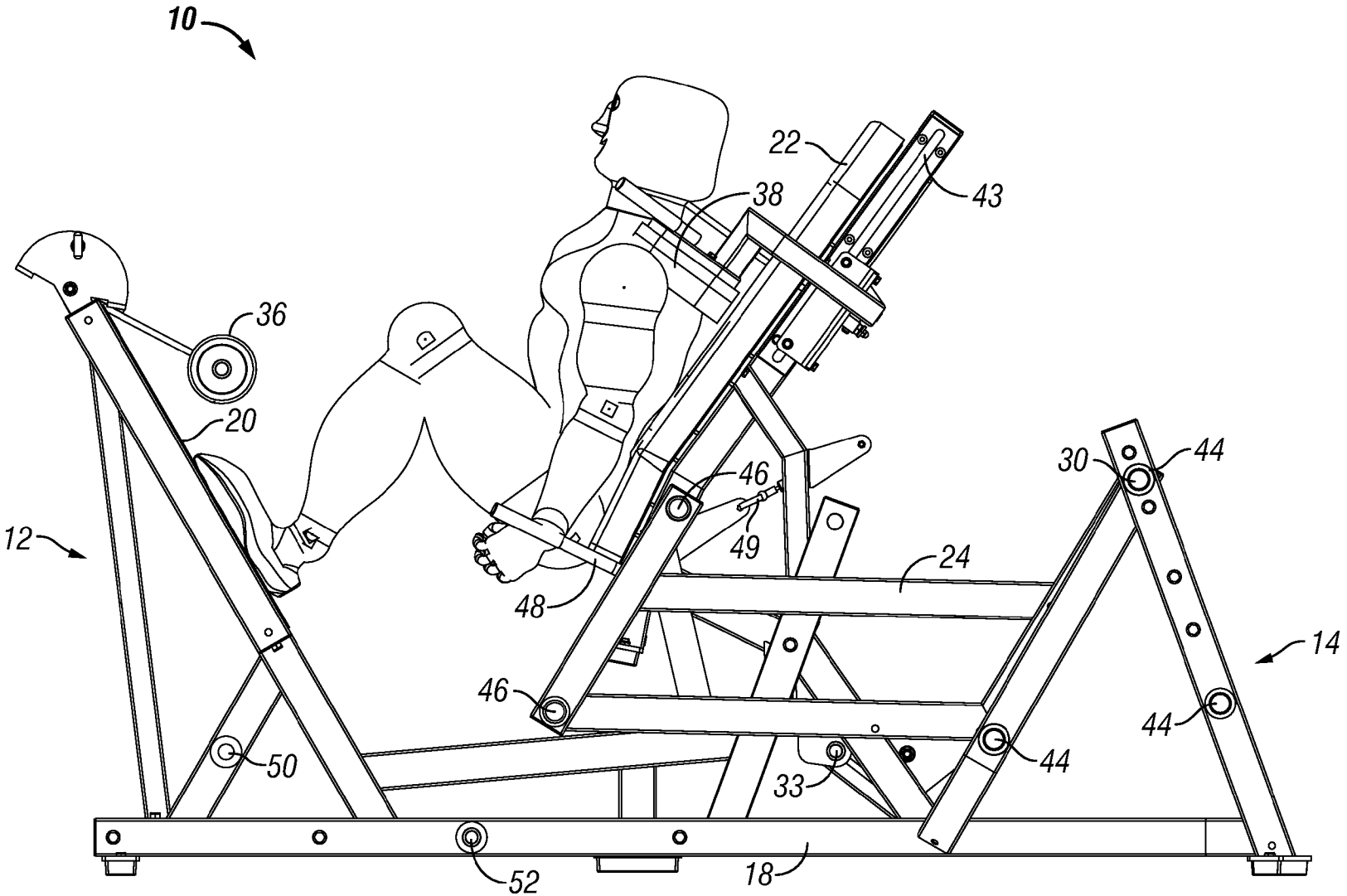
FIG. 2 is a side elevation of the squat machine of the present invention with a user in a squat or crouched position.
Figure 3:
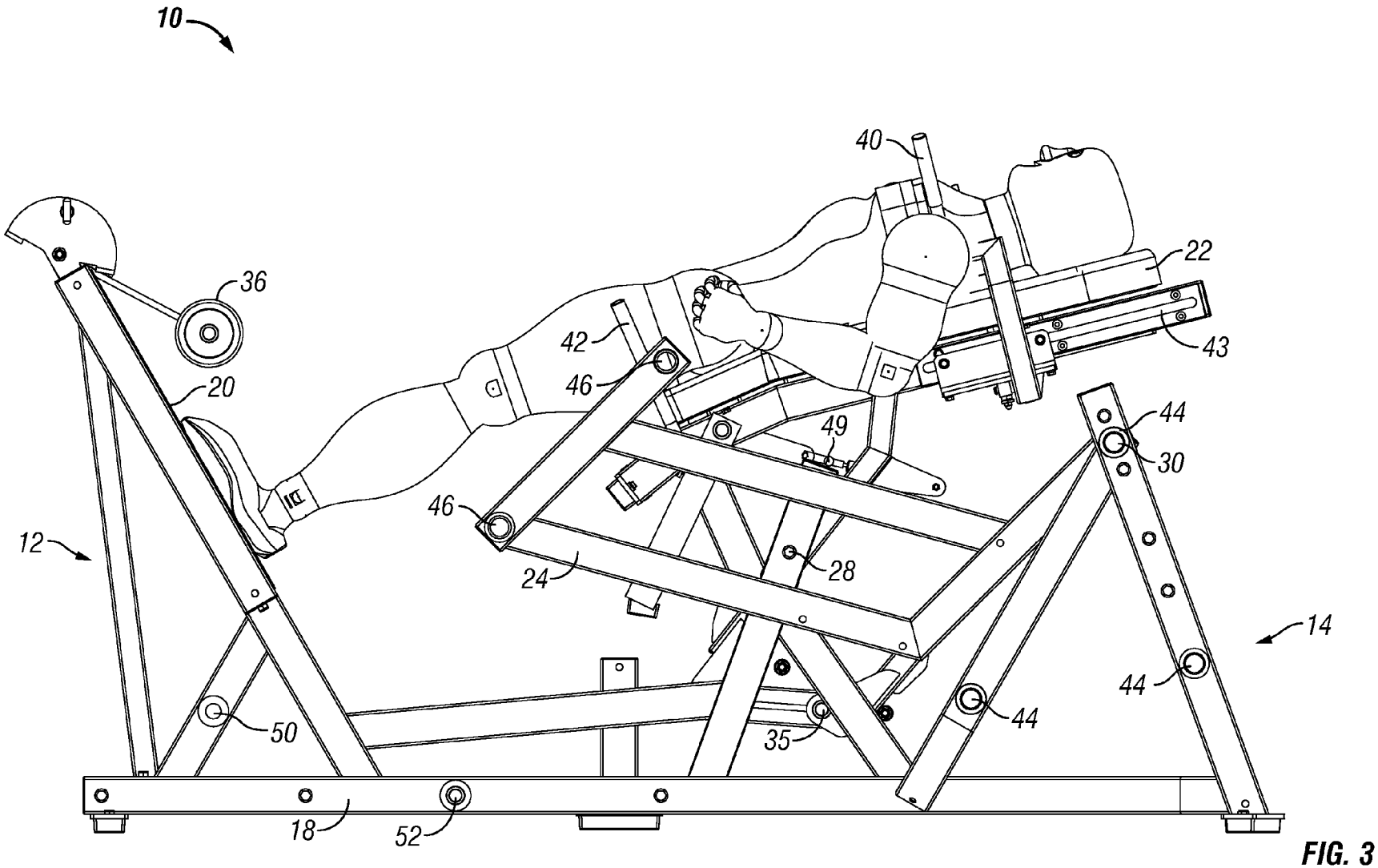
FIG. 3 is a side elevation view of the squat machine of the present invention with the user in an extended or straight body position.

A person using the squat machine 10 is initially positioned in an intermediate position, as shown in FIG. 2, with their back against the back rest 22, their feet against the foot plate 20, and their knees bent. The person then straightens their legs so as to rotate the back rest 22 rearwardly to a nearly horizontal position, as shown in FIG. 3, against the resistance of weight plates on the frame assemblies 24 on each side of the base 12. The resistive force may be applied by other means than the weights. For example, elastic bands on each side of the machine 10 can be stretched between the stub shafts 46 on the assembly 24 and stub shafts 50 at the front of the base 12, and around stub shafts 52 on the base. As a further alternative, a cable system with vertically stacked weights may be used, as well as flexible rods, bars, springs, and other forms of ballast or resistance force.

Proper foot positioning on the squat machine 10 prevents a user from extending his/her knees beyond their toes, and thereby minimizes or eliminates the potential for knee shear while providing full range of motion through the hips. Also, spinal compression is avoided, since the resistive force is not being applied from above the user's shoulders. Furthermore, the back rest 22 distributes the load of the resistive force across the user's hips, back and shoulders, and thereby further minimize or eliminate the risk of compression of the spine.

The squat machine 10 provides resistance throughout the range of motion of the back rest 22. The four bar parallelogram frame of the assembly 24 allows the resistive force to be applied and maintained in a manner that is appropriate to the exercise, throughout the range of motion.

As seen in the drawings, the user is oriented in a nearly horizontal position when fully extended, as opposed to a vertical or standing position. This horizontal positioning of the user removes the user's body weight from the exercise, and thereby allows a resistive force less than the body weight, which is desirable in some muscle rehabilitation therapies.

In the preferred embodiment shown in the figures, it is noted that the linkage 26 has a relatively short length between the back rest 22 and the assembly 24. During use of the machine 10, the parallelogram frame of the assembly 24 moves the weights or resistive force in the preferred embodiment through an arc having a horizontal component. These structural relationships between the back rest 22, assembly 24, and linkage 26 facilitates and enhances the overall effectiveness of the exercising performed by a user on the machine 10.

What is claimed is:

1. A squat machine, comprising:

a base resting upon a floor;

a stationary foot plate on the base;

a back rest pivotally mounted to the base for movement between a squat position and an extended position by a person positioned with their back engaging the back rest and at least one foot engaging the foot plate;

an assembly pivotally connected to the base for attaching a resistance force;

a rigid linkage having opposite ends pivotally connected to the back rest and to the assembly respectively, for operatively connecting the assembly to the back rest; and the back rest being oriented at approximately a 45°-60° angle in the squat position and moving rearwardly towards a horizontal orientation in the extended position;

wherein the assembly swings forwardly toward the foot plate when the back rest moves rearwardly toward the extended position.

2. The squat machine of claim 1 wherein the resistance force moves with a horizontal component when the back rest moves between the squat and extended positions.

3. The squat machine of claim 1 wherein the assembly includes a pair of parallelogram frames with one frame on each side of the back rest.

4. The squat machine of claim 1 wherein the assembly includes arms on opposite sides of the assembly for supporting plate weights.

5. The squat machine of claim 1 further comprising a foot rest spaced from the foot plate to support one leg of a user off the foot plate while the other foot engages the foot plate.

6. The squat machine of claim 1 wherein the base includes stub shafts to store plate weights.

7. The squat machine of claim 1 further comprising shoulder pads adjustably mounted on the back rest.

8. The squat machine of claim 1 further comprising upper and lower hand grips on the back rest.

9. The squat machine of claim 1 further comprising an adjustable leg rest on the foot plate.

10. A squat machine, comprising:

a base having opposite sides;

a foot plate rigidly fixed to the base;

a pair of frames each being pivotally mounted to respective sides of the base;

a back rest pivotally mounted to the frames so that the frames and back rest are movable between an initial squat position and an extended position;

whereby a user's knees remain behind their toes throughout full range of motion through the hips during movement of the back rest against a resistive force;

wherein the frame swings forwardly toward the foot plate when the back rest moves rearwardly toward the extended position.

11. The squat machine of claim 10 wherein the back rest resides between vertical planes defined by the frames.

12. The squat machine of claim 10 wherein the back rest is oriented at approximately a 45°-60° angle in the squat position and moving towards a horizontal orientation in the extended position.

13. The squat machine of claim 10 wherein each frame is a parallelogram.

14. The squat machine of claim 10 further comprising a lock member for locking the back rest in a position between the squat and extended positions.

15. The squat machine of claim 10 wherein each frame has an upper end pivotally connected to the base and a lower end pivotally connected to the back rest.

16. The squat machine of claim 10 further comprising an upper pivot axis between the base and the frames and a lower pivot axis between the back rest and the frames.

17. The squat machine of claim 10 further comprising shoulder pads adjustably mounted on the back rest.

18. The squat machine of claim 10 further comprising an adjustable leg rest on the foot plate.

* * * * *